US011671747B2

(12) United States Patent
Li et al.

(10) Patent No.: US 11,671,747 B2
(45) Date of Patent: Jun. 6, 2023

(54) TUNABLE LOUDSPEAKER ABSORBER

(71) Applicant: Toyota Motor Engineering & Manufacturing North America, Inc., Plano, TX (US)

(72) Inventors: Xiaopeng Li, Ann Arbor, MI (US); Taehwa Lee, Ann Arbor, MI (US); Hideo Iizuka, Ann Arbor, MI (US)

(73) Assignee: Toyota Motor Engineering & Manutacturing North America, Inc., Plano, TX (US)

( * ) Notice: Subject to any disclaimer, the term of this patent is extended or adjusted under 35 U.S.C. 154(b) by 0 days.

(21) Appl. No.: 17/180,179

(22) Filed: Feb. 19, 2021

(65) Prior Publication Data

US 2022/0272438 A1 Aug. 25, 2022

(51) Int. Cl.
*H04R 1/28* (2006.01)
*H04R 3/00* (2006.01)

(52) U.S. Cl.
CPC ..... *H04R 1/288* (2013.01); *H04R 3/00* (2013.01)

(58) Field of Classification Search
CPC ..... H04R 1/288; H04R 3/00
See application file for complete search history.

(56) References Cited

U.S. PATENT DOCUMENTS 3,554,314 A * 1/1971 Schneidewind ..... H04R 1/2865 52/287.1
5,297,212 A * 3/1994 Murayama ..... H03G 5/04 381/103
5,691,516 A 11/1997 Thomasen
7,065,221 B1 * 6/2006 Tanaka ..... H04R 1/30 381/59
7,466,838 B1 * 12/2008 Moseley ..... H04R 1/1008 381/74
9,275,628 B2 3/2016 Schnitta et al.
9,369,805 B2 6/2016 Wilson
2001/0050196 A1 * 12/2001 Okada ..... G10K 11/162 181/175
2002/0000879 A1 * 1/2002 Brown, Sr. ..... H03F 1/3264 330/86

(Continued)

FOREIGN PATENT DOCUMENTS

WO 2014026165 A2 2/2014

OTHER PUBLICATIONS

Lissek et al., "Eletroacoustic absorbers: Bridging the gap between shunt loudspeakers and active sound absorption", The Journal of Acoustical Society of America, Feb. 24, 2011, pp. 2968-2978 (11 pages).

(Continued)

*Primary Examiner* — Andrew L Sniezek
(74) *Attorney, Agent, or Firm* — Christopher G. Darrow; Darrow Mustafa PC

(57) ABSTRACT

A system can improve the performance of an electroacoustic absorber. The system includes a loudspeaker and an absorber operatively positioned relative to the loudspeaker. The absorber can be configured to absorb sound waves. A control circuit can be operatively connected to the loudspeaker. The control circuit can be configured to tune the resonance of the loudspeaker and therefore cause one or more acoustic characteristics, such as acoustic impedance, of the loudspeaker to be adjusted.

16 Claims, 6 Drawing Sheets

(56) References Cited

U.S. PATENT DOCUMENTS

| | | | | |
|---|---|---|---|---|
| 2006/0067555 | A1* | 3/2006 | Tsai | H04R 1/1016 381/382 |
| 2007/0215407 | A1 | 9/2007 | Chiang | |
| 2010/0054524 | A1* | 3/2010 | Horigome | H04R 9/043 381/413 |
| 2016/0090885 | A1* | 3/2016 | Hölsch | G10K 11/17833 701/102 |
| 2020/0279547 | A1 | 9/2020 | Christoph | |

OTHER PUBLICATIONS

Boulandet, "Tunable Electroacoustic Resonators through Active Impedance Control of Loudspeakers", École Polytechnique Fédérale De Lausanne, 2012 (220 pages).

Zhao et al., "A continuously tunable acoustic metasurface for transmitted wavefront manipulation", Phys. Rev. Applied, 2018 (22 pages).

* cited by examiner

TUNABLE LOUDSPEAKER ABSORBER

FIELD

The subject matter described herein relates in general to electroacoustics and, more particularly, to electroacoustic absorbers.

BACKGROUND

An electroacoustic absorber can include a loudspeaker. The acoustic impedance of the loudspeaker can be varied by electrical means. For instance, the loudspeaker can be shunted with an electrical circuit designed to obtain a given acoustic impedance.

SUMMARY

In one respect, the present disclosure is directed to a system. The system includes a loudspeaker and an absorber operatively positioned relative to the loudspeaker. The loudspeaker can function as a resonator. The absorber can be configured to absorb sound waves. A control circuit can be operatively connected to the loudspeaker. The control circuit can be configured to tune a resonance of the loudspeaker, thereby causing an acoustic impedance of the loudspeaker to be adjusted.

In another respect, the present disclosure is directed to a system. The system includes a loudspeaker and an absorber operatively positioned with respect to the loudspeaker. The system includes a microphone. The microphone can be operatively positioned proximate the loudspeaker. The microphone can be configured to acquire sound data of a sound wave. The system can include a control circuit operatively connected to the microphone and to the loudspeaker. The control circuit can be configured to tune a resonance of the loudspeaker, thereby causing an acoustic impedance of the loudspeaker to be adjusted.

DETAILED DESCRIPTION

Figure 1:
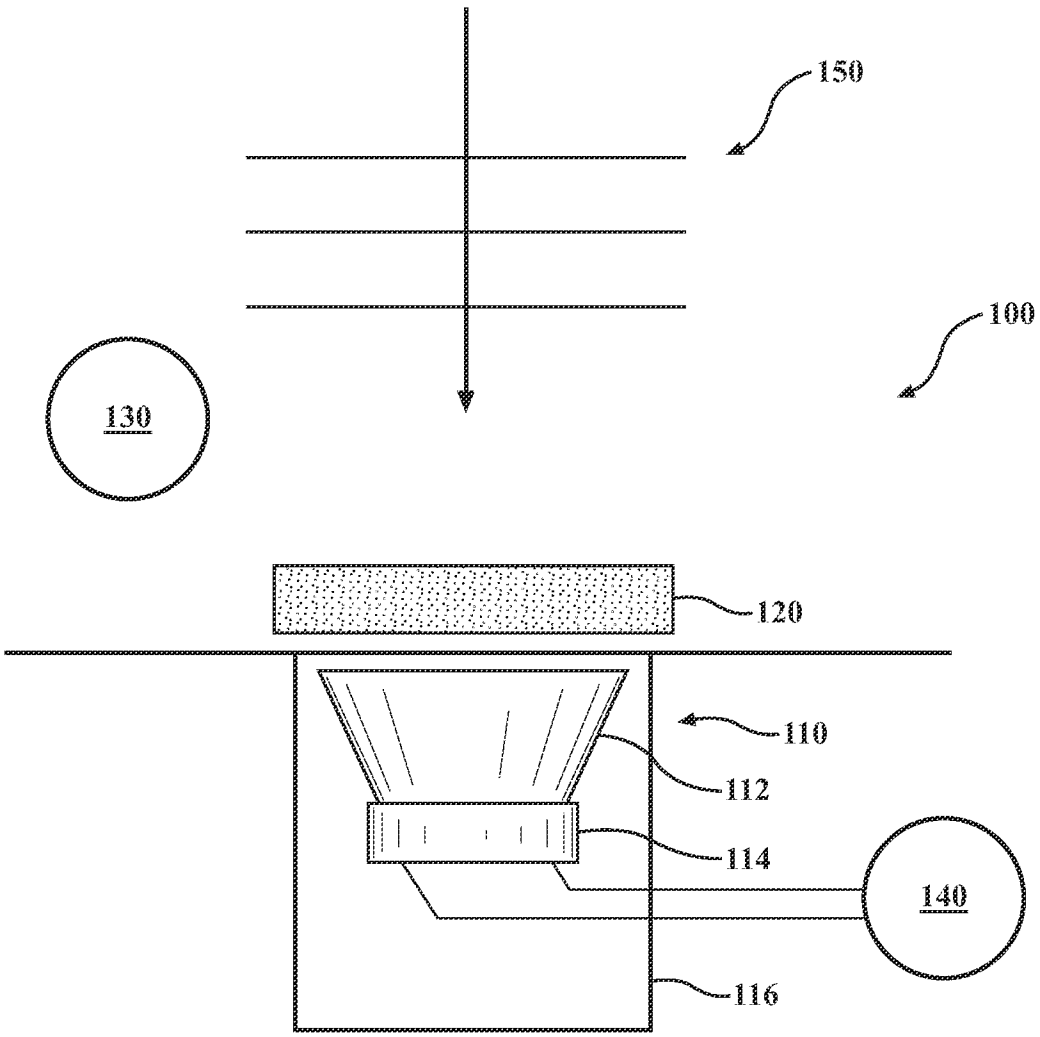
FIG. 1 is an example of a portion of an electroacoustic absorber system.

Noise levels in certain environments and applications can be annoying or even harmful. Health, comfort, and/or productivity can be adversely affected when exposed to unacceptable noise levels. Accordingly, arrangements described herein are directed to an electroacoustic absorber with improved sound absorbing performance. Such improved performance can be achieved by using a physical acoustic absorber structure in connection with an electroacoustic absorber.

Membrane-type acoustic metamaterials have demonstrated unusual capacity in controlling sound transmission, reflection and absorption at low frequency. In the design of membrane-type acoustic metamaterials, a prestressed force is usually applied to the membrane to increase the stiffness. However, due to the presence of prestress, it increases the fabrication difficulties. Meanwhile, most of the existing passive membrane-type acoustic metamaterials lack of tunability. To design a tunable acoustic absorber at low frequency is still desired.

Detailed embodiments are disclosed herein; however, it is to be understood that the disclosed embodiments are intended only as examples. Therefore, specific structural and functional details disclosed herein are not to be interpreted as limiting, but merely as a basis for the claims and as a representative basis for teaching one skilled in the art to variously employ the aspects herein in virtually any appropriately detailed structure. Further, the terms and phrases used herein are not intended to be limiting but rather to provide an understandable description of possible implementations. Various embodiments are shown in FIGS. 1-8, but the embodiments are not limited to the illustrated structure or application.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details.

Referring to FIG. 1, an example of a portion of an electroacoustic absorber system 100 is shown. The electroacoustic absorber system 100 can include a loudspeaker 110, one or more absorbers 120, one or more microphones 130, and a control circuit 140.

The loudspeaker 110 can be any type of loudspeaker, now known or later developed. The loudspeaker can convert electrical signals into sound waves. The loudspeaker 110 can include various components, such as a diaphragm 112, a coil, and a magnet 114. In some arrangements, the diaphragm 112 can be substantially cone shaped. In some arrangements, the loudspeaker 110 can include an enclosure 116, such as a cabinet or housing, in which at least some of its components can be contained.

The absorber(s) 120 made of damping materials, such as foam material, can be any structure configured to absorb or dampen sound waves 150. The foam can provide additional damping to the speaker resonator. The foam material can provide enough damping for the absorber to maximize absorption. The absorber(s) 120 can be made of any suitable material. For example, the absorber(s) 120 can be made of foam, rubber, polyurethane, elastomeric rubber, or polyethylene, just to name a few possibilities. In some arrangements, the absorber(s) 120 can be a porous material. As will be explained in further detail herein, the absorber(s) 120 can be operatively positioned relative to the loudspeaker 110.

The absorber(s) 120 can be a single piece of material. The absorber(s) 120 can be made of a plurality pieces of material that are joined together. The absorber(s) 120 can include one or more layers. The absorber(s) 120 can have any suitable size, shape, and/or configuration. In some arrangements, the absorber(s) 120 can be substantially rectangular or substantially circular in shape. The absorber(s) 120 can have a thickness. The thickness of the absorber(s) 120 can be substantially uniform.

The microphone(s) 130 can be configured to acquire sound data of a sound wave (e.g., sound wave 150) relative to the loudspeaker 110. The microphone(s) 130 can be any type of microphone, now known or later developed. The microphone(s) 130 can be operatively positioned proximate the loudspeaker 110. More particularly, the microphone(s) 130 can be operatively positioned proximate the diaphragm 112 of the loudspeaker 110. The microphone(s) 130 can be operatively positioned upstream of and to the side of the loudspeaker 110 relative to the direction of an incoming sound wave. An incoming sound wave includes a sound wave generally headed in a direction toward the loudspeaker 110. The incoming sound wave can be produced by a source external to the electroacoustic absorber system 100. The microphone(s) 130 can also acquire sound data of a reflected sound wave.

The microphone(s) 130 can detect, determine, assess, monitor, measure, quantify and/or sense in real-time. As used herein, the term "real-time" means a level of processing responsiveness that a user, entity, component, and/or system senses as sufficiently immediate for a particular process or determination to be made, or that enables a processor to process data at substantially the same rate as some external process or faster.

The microphone(s) 130 can be operatively connected to the control circuit 140 and/or can be a part of the control circuit 140. The loudspeaker(s) 110 can be operatively connected to the control circuit 140 and/or can be a part of the control circuit 140. The control circuit 140 can be configured to tune the resonance of the loudspeaker and therefore cause one or more acoustic characteristics of the loudspeaker(s) 110 to be adjusted, such as an acoustic impedance of the loudspeaker(s) 110.

Figure 2:
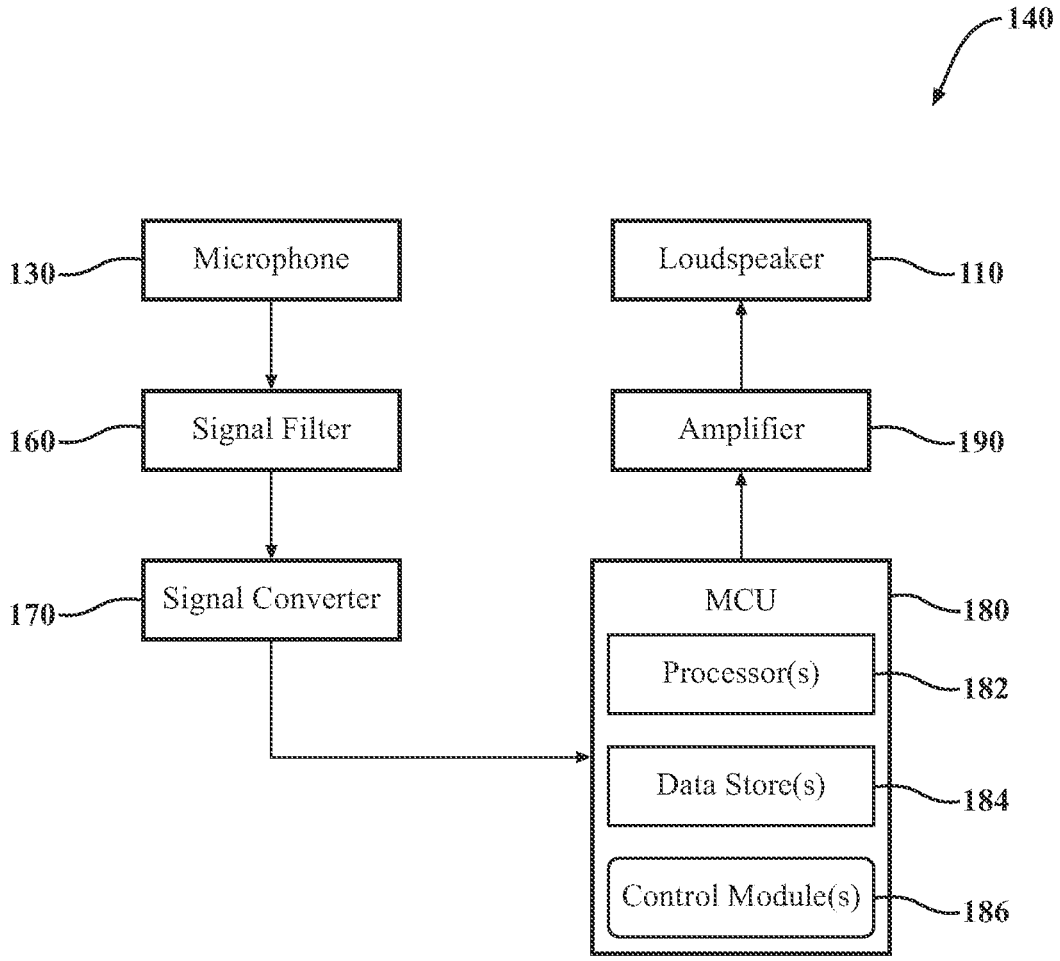
FIG. 2 is an example of the electroacoustic absorber system.

Referring to FIG. 2, and example of the control circuit 140 is shown. Some of the possible elements of the control circuit 140 are shown in FIG. 2 and will now be described. It will be understood that it is not necessary for the control circuit 140 to have all of the elements shown in FIG. 1 or described herein. The control circuit 140 can include one or more microphones 130, one or more signal filters 160, one or more signal converters 170, one or more master control units 180, one or more amplifiers 190, and/or one or more loudspeakers 110.

The various elements of the control circuit 140 can be communicatively linked to each other (or any combination thereof) through one or more communication networks. As used herein, the term "communicatively linked" can include direct or indirect connections through a communication channel or pathway or another component or system. A "communication network" means one or more components designed to transmit and/or receive information from one source to another. The master control unit(s) 180 and/or one or more of the elements of the control circuit 140 can include and/or execute suitable communication software, which enables the various elements to communicate with each other through the communication network and perform the functions disclosed herein.

The one or more communication networks can be implemented as, or include, without limitation, a wide area network (WAN), a local area network (LAN), the Public Switched Telephone Network (PSTN), a wireless network, a mobile network, a Virtual Private Network (VPN), the Internet, and/or one or more intranets. The one or more communication networks further can be implemented as or include one or more wireless networks, whether short range (e.g., a local wireless network built using a Bluetooth or one of the IEEE 802 wireless communication protocols, e.g., 802.11a/b/g/i, 802.15, 802.16, 802.20, Wi-Fi Protected Access (WPA), or WPA2) or long range (e.g., a mobile, cellular, and/or satellite-based wireless network; GSM, TDMA, CDMA, WCDMA networks or the like). The communication network(s) can include wired communication links and/or wireless communication links. The communication network(s) can include any combination of the above networks and/or other types of networks, now known or later developed.

Each of the above noted elements of the control circuit 140 will be described in turn below. The control circuit 140 can include one or more microphones 130. The above description of the microphone(s) 130 in connection with FIG. 1 applies equally here.

The control circuit 140 can include one or more signal filters 160. The signal filter(s) 160 can be operatively connected to receive sound data from the microphone(s) 130. The signal filter(s) 160 can be any type of signal filter, now known or later developed. The signal filter(s) 160 can be configured to filter the sound data acquired by the microphone(s) 130 according to one or more criteria, which can be predefined criteria. In one or more arrangements, the signal filter(s) 160 can include one or more band pass filters, which can be used to filter high and/or low frequency noise.

In some arrangements, the control circuit 140 can include one or more signal converters 170. The signal converter(s) 170 can be configured to convert the sound data from one form into another form. For instance, the signal converter(s) 170 can be configured to convert the sound data into a square wave. Such conversion can be helpful in detecting the frequency of the sound wave 150.

The control circuit 140 can include one or more master control units (MCU) 180. In some arrangements, the master control unit(s) 180 can include one or more processors 182, one or more data stores 184, and one or more control modules 186. In other arrangements, the one or more processors 182, one or more data stores 184, and one or more control modules 186 can be provided separately from a master control unit.

"Processor" means any component or group of components that are configured to execute any of the processes described herein or any form of instructions to carry out such processes or cause such processes to be performed. The processor(s) 182 may be implemented with one or more general-purpose and/or one or more special-purpose processors. Examples of suitable processors include microprocessors, microcontrollers, DSP processors, and other circuitry that can execute software. Further examples of suitable processors include, but are not limited to, a central processing unit (CPU), an array processor, a vector processor, a digital signal processor (DSP), a field-programmable gate array (FPGA), a programmable logic array (PLA), an application specific integrated circuit (ASIC), programmable logic circuitry, and a controller. The processor(s) 182 can include at least one hardware circuit (e.g., an integrated circuit) configured to carry out instructions contained in program code. In arrangements in which there is a plurality of processors 182, such processors can work independently from each other or one or more processors can work in combination with each other.

The more data store(s) 184 can be configured to store one or more types of data. The data store(s) 184 can include volatile and/or non-volatile memory. Examples of suitable data stores 184 include RAM (Random Access Memory), flash memory, ROM (Read Only Memory), PROM (Programmable Read-Only Memory), EPROM (Erasable Programmable Read-Only Memory), EEPROM (Electrically Erasable Programmable Read-Only Memory), registers, magnetic disks, optical disks, hard drives, or any other suitable storage medium, or any combination thereof. The data store(s) 184 can be a component of the processor(s) 182, or the data store(s) 184 can be operatively connected to the processor(s) 182 for use thereby. The data store(s) 184 can store information about any of the elements of the control circuit 140 and/or the electroacoustic absorber system 100.

The master control unit(s) 180 can include one or more modules. The modules can be implemented as computer readable program code that, when executed by a processor, implement one or more of the various processes described herein. One or more of the modules can be a component of the processor(s) 182, or one or more of the modules can be executed on and/or distributed among other processing systems to which the processor(s) 182 is operatively connected. The modules can include instructions (e.g., program logic) executable by one or more processor(s) 182. Alternatively or in addition, one or more data stores 184 may contain such instructions. The modules described herein can include artificial or computational intelligence elements, e.g., neural network, fuzzy logic or other machine learning algorithms. Further, the modules can be distributed among a plurality of modules.

The master control unit(s) 180 can include one or more control modules 186. The control module(s) 186 can include profiles and logic for controlling one or more elements of the electroacoustic absorber system 100 according to arrangements herein. The control module(s) 186 can be configured to do so in any suitable manner, such as automatically, continuously, periodically, irregularly, randomly, or in response to a user command.

The control module(s) 186 can be configured to process or analyze sound data or information acquired by the microphone(s) 130. The control module(s) 186 can receive raw data from the microphone(s) 130 or sound data that has been filtered by the signal filter(s) 160 and/or that has been converted by the signal converter(s) 170. The control module(s) 186 can analyze the sound data to determine one or more characteristics of the sound wave 150. For example, the control module(s) 186 can determine the frequency of the sound wave 150.

Based on the one or more characteristics of the sound wave 150, the control module(s) 186 can be configured to determine appropriate controls to implement. For example, the control module(s) 186 can determine an appropriate control signal to provide the loudspeaker 110 such that the acoustic impedance at the diaphragm 112 of the loudspeaker 110 allows for the sound wave 150 to be absorbed. The control module(s) 186 can be configured to cause one or more acoustic characteristics (e.g., acoustic impedance) of the loudspeaker 110 to be adjusted. The control module(s) 186 can do so, for example, by changing the amount of current to the loudspeaker(s) 110. Changing the current supplied to the loudspeaker(s) 110 can change the resonance of the loudspeaker(s) 110. Thus, the loudspeaker(s) 110 can be tunable based on real-time conditions of external sound waves.

The control circuit 140 can include one or more amplifiers 190. The amplifier(s) 190 can be any type of amplifier, now known or later developed. The amplifier(s) 190 can be operatively connected to the master control unit(s) 180 and to the loudspeaker(s) 110. The master control unit(s) 180 can output current to the amplifier(s) 190.

The control circuit 140 can include one or more loudspeakers 110. The above description of the loudspeaker(s) 110 in connection with FIG. 1 applies equally here.

The absorber(s) 120 can be operatively positioned relative to the loudspeaker 110 in any suitable manner. Non-limiting examples are shown in FIGS. 1 and 3-5. In one or more arrangements, the absorber(s) 120 can be positioned in front of the diaphragm 112 of the loudspeaker 110, as shown in FIG. 1. Thus, incoming sound waves pass through the absorber prior to reaching the loudspeaker 110.

Figure 3:
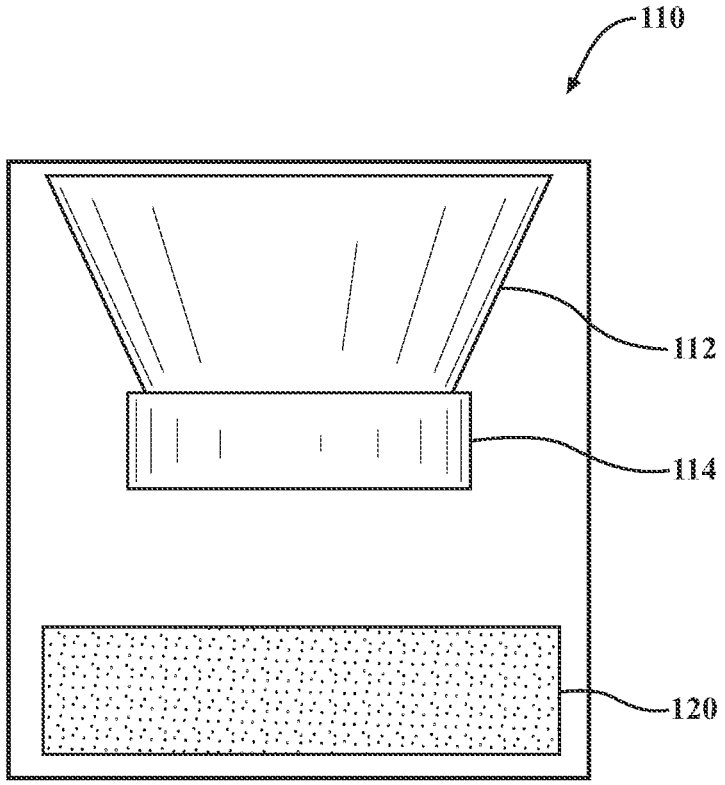
FIG. 3 is an example of an arrangement of a loudspeaker and an absorber.
Figure 4:
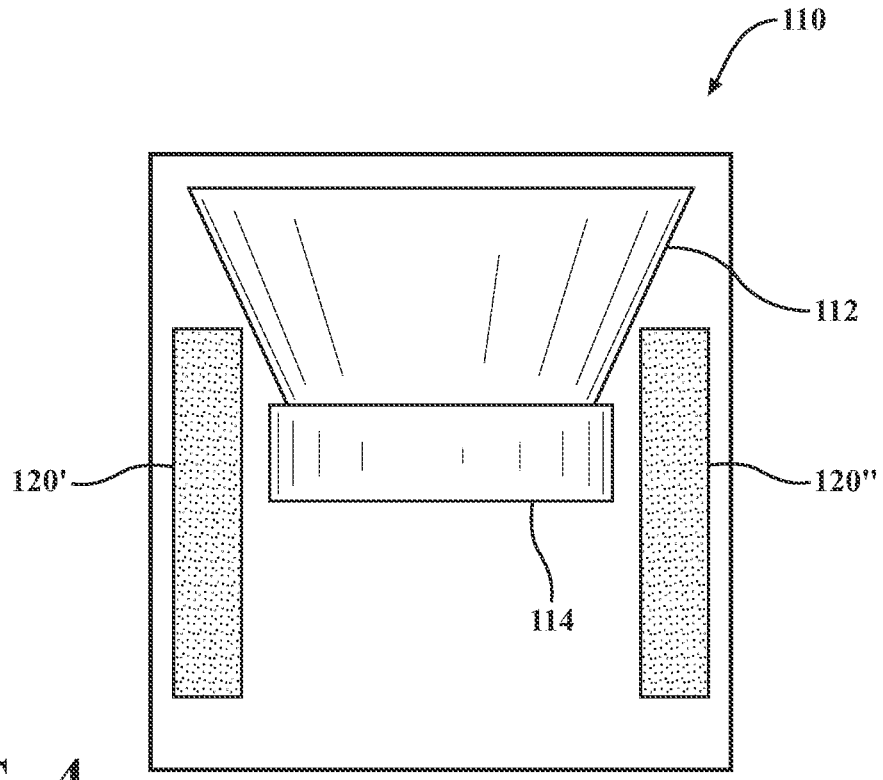
FIG. 4 is an example of an arrangement of a loudspeaker and an absorber.
Figure 5:
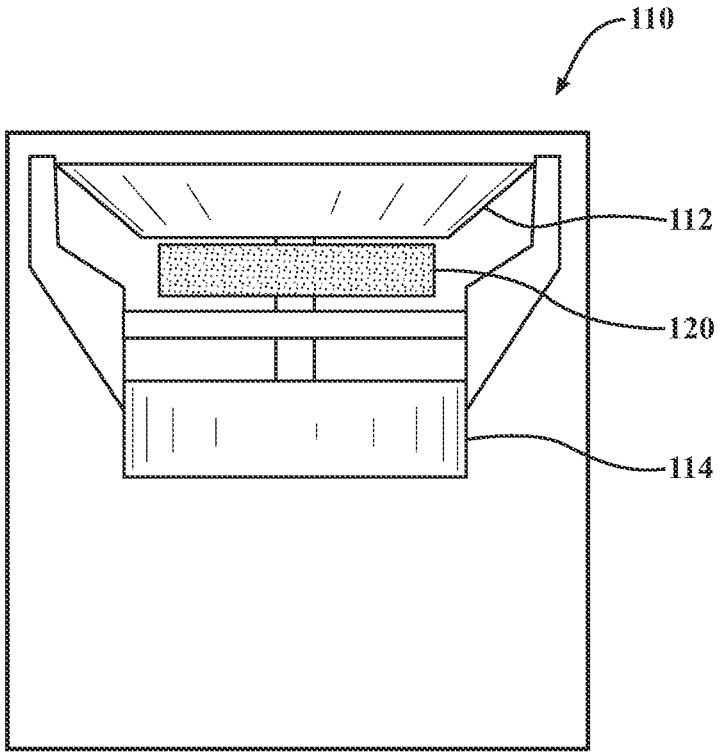
FIG. 5 is an example of an arrangement of a loudspeaker and an absorber.

Referring the FIG. 3, the absorber(s) 120 can be positioned behind the loudspeaker 110 opposite to the diaphragm 112 of the loudspeaker 110. In FIG. 4, the absorber(s) 120 can include a first absorber 120' and a second absorber 120". The first absorber 120' and the second absorber 120" can be positioned on opposite lateral sides of the loudspeaker 110. Referring to FIG. 5, the absorber(s) 120 can be positioned between the diaphragm 112 and the magnet 114 of the loudspeaker 110. Of course, the absorber(s) 120 can be positioned in any combination of the above arrangements. Further, it will be appreciated that other arrangements are possible. Further, it will be appreciated that more than one absorber can be used in the various locations shown in the various figures. The absorber(s) 120 can be located adjacent to the loudspeaker 110 of the electroacoustic absorber system 100.

The electroacoustic absorber system 100 described herein can be used in various ways. Non-limiting examples of the use of the electroacoustic absorber system 100 will now be presented in connection to FIGS. 6-8. It should be noted that, in these examples, the arrangements of the absorber 120 and the loudspeaker 110 from FIG. 1 are shown. However, it will be appreciated that any of the arrangements described herein can be used.

Figure 6:
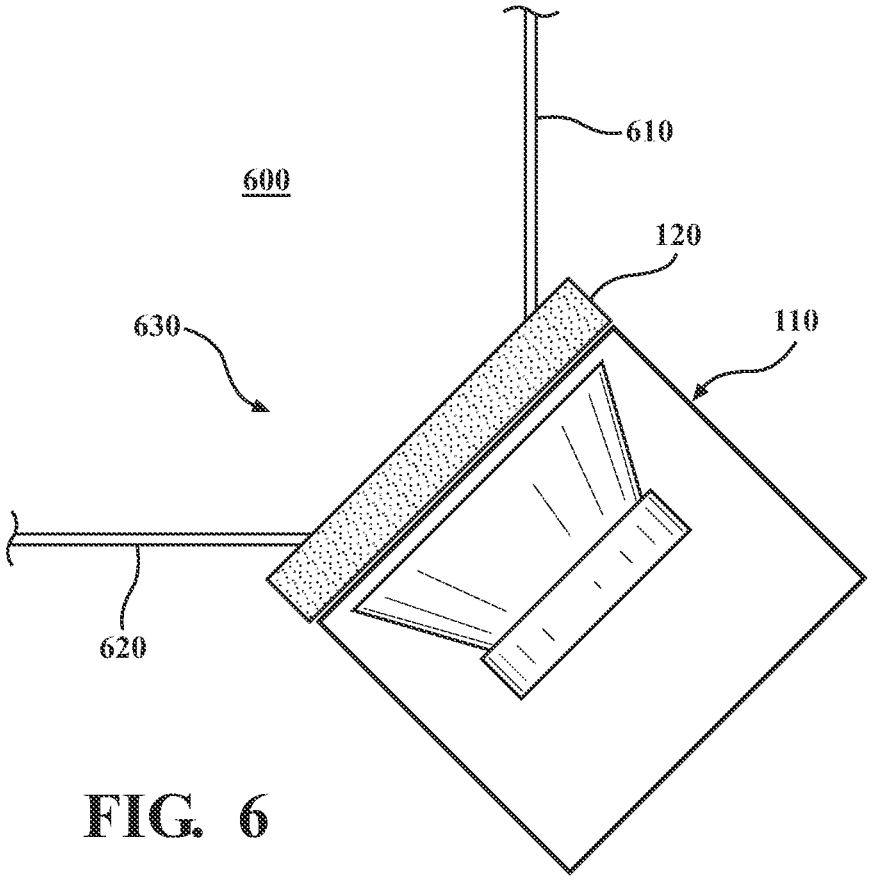
FIG. 6 is an example of the use of the electroacoustic absorber system in a corner of a space.

FIG. 6 is an example of the use of the electroacoustic absorber system 100 in a corner 630 of a space 600, such as a room, a vehicle cabin, or other open environment. The space 600 can be defined at least partially by a first wall 610 and a second wall 620. The first wall 610 and the second wall 620 can meet and can define the corner 630. In some arrangements, a cavity 640 can be defined in the corner 630. The loudspeaker 110 and/or the absorber 120 can be operatively positioned in the cavity 640. The loudspeaker 110 can face toward the space 600. In some instances, the electroacoustic absorber system 100 can be used as a bass trap.

Figure 7:
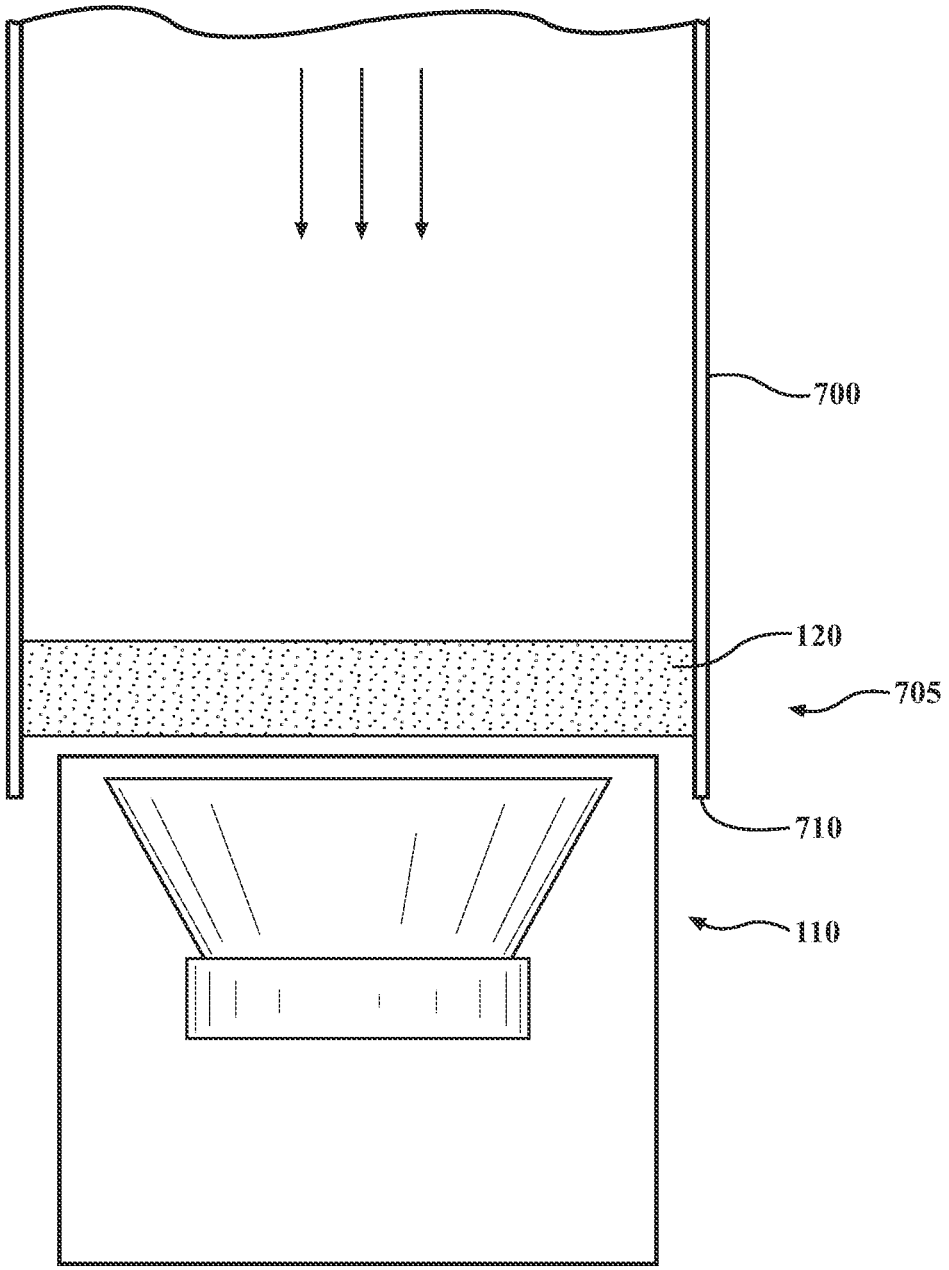
FIG. 7 is a first example of the use of the electroacoustic absorber system in connection with a duct.
Figure 8:
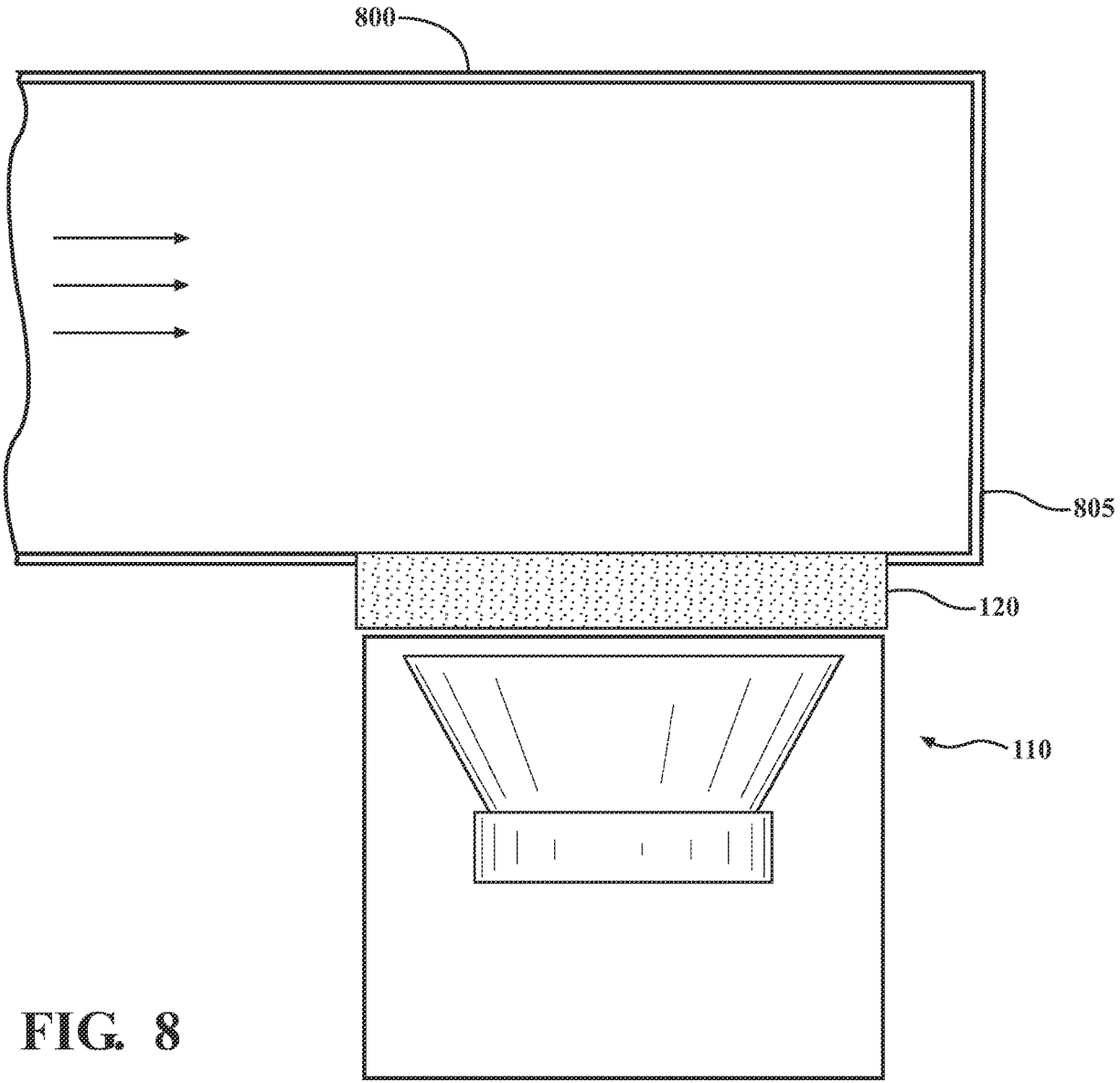
FIG. 8 is a second example of the use of the electroacoustic absorber system in connection with a duct.

FIGS. 7 and 8 show examples of the use of the electroacoustic absorber system 100 in connection with a duct. The duct can be, for example, an air intake or exhaust pipe of an internal combustion engine.

In FIG. 7, the loudspeaker 110 and the absorber 120 can be operatively positioned at an end region 705 of a duct 700. In some arrangements, the end region 705 can include the end 710 of the duct 700. The absorber 120 can be located within the duct 700. The loudspeaker 110 can be located at least partially within the duct 700. While not shown in FIG. 7, the microphone 130 can of course be located in any suitable positioned proximate the loudspeaker 110 as described herein.

FIG. 8 shows an arrangement in which the loudspeaker 110 and the absorber 120 can be positioned in branched relation along a duct 800. The loudspeaker 110 and the absorber 120 can be located in any suitable location along the duct 800. As an example, the loudspeaker 110 and the absorber 120 can be located proximate an end 805 of the duct 800. While not shown in FIG. 8, the microphone 130 can of course be located in any suitable positioned proximate the loudspeaker 110 as described herein.

It will be appreciated that arrangements described herein can provide numerous benefits, including one or more of the benefits mentioned herein. For example, arrangements described herein can improve the performance of an electroacoustic absorber. The additional absorber structure described herein can improve the sound absorbing performance. By adding an absorber, the system can be a resonator with additional damping. By measuring characteristics of an incoming sound wave and by including the absorbing material, arrangements described herein can be used to suppress a reflected wave. Arrangements described herein can result in an electroacoustic absorber that is tunable. Arrangements described herein can reduce annoying or harmful noises. Arrangements described herein can facilitate health, productivity, and/or comfort.

The flowcharts and block diagrams in the figures illustrate the architecture, functionality, and operation of possible implementations of systems, methods and computer program products according to various embodiments. In this regard, each block in the flowcharts or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved.

The systems, components and/or processes described above can be realized in hardware or a combination of hardware and software and can be realized in a centralized fashion in one processing system or in a distributed fashion where different elements are spread across several interconnected processing systems. Any kind of processing system or other apparatus adapted for carrying out the methods described herein is suited. A typical combination of hardware and software can be a processing system with computer-usable program code that, when being loaded and executed, controls the processing system such that it carries out the methods described herein. The systems, components and/or processes also can be embedded in a computer-readable storage, such as a computer program product or other data programs storage device, readable by a machine, tangibly embodying a program of instructions executable by the machine to perform methods and processes described herein. These elements also can be embedded in an application product which comprises all the features enabling the implementation of the methods described herein and, which when loaded in a processing system, is able to carry out these methods.

The terms "a" and "an," as used herein, are defined as one or more than one. The term "plurality," as used herein, is defined as two or more than two. The term "another," as used herein, is defined as at least a second or more. The terms "including" and/or "having," as used herein, are defined as comprising (i.e. open language). The term "or" is intended to mean an inclusive "or" rather than an exclusive "or." The phrase "at least one of . . . and . . . ." as used herein refers to and encompasses any and all possible combinations of one or more of the associated listed items. As an example, the phrase "at least one of A, B and C" includes A only, B only, C only, or any combination thereof (e.g. AB, AC, BC or ABC). As used herein, the term "substantially" or "about" includes exactly the term it modifies and slight variations therefrom. Thus, the term "substantially parallel" means exactly parallel and slight variations therefrom. "Slight variations therefrom" can include within 15 degrees/percent/units or less, within 14 degrees/percent/units or less, within 13 degrees/percent/units or less, within 12 degrees/percent/units or less, within 11 degrees/percent/units or less, within 10 degrees/percent/units or less, within 9 degrees/percent/units or less, within 8 degrees/percent/units or less, within 7 degrees/percent/units or less, within 6 degrees/percent/units or less, within 5 degrees/percent/units or less, within 4 degrees/percent/units or less, within 3 degrees/percent/units or less, within 2 degrees/percent/units or less, or within 1 degree/percent/unit or less. In some instances, "substantially" can include being within normal manufacturing tolerances.

Aspects herein can be embodied in other forms without departing from the spirit or essential attributes thereof. Accordingly, reference should be made to the following claims, rather than to the foregoing specification, as indicating the scope of the invention.

What is claimed is:

1. A system comprising:

a loudspeaker;

an absorber operatively positioned relative to the loudspeaker, the absorber being configured to absorb sound waves;

a microphone operatively positioned proximate the loudspeaker, the absorber being located between the microphone and the loudspeaker; and a control circuit operatively connected to the loudspeaker, the control circuit being configured to tune a resonance of the loudspeaker, thereby causing an acoustic impedance of the loudspeaker to be adjusted.

2. The system of claim 1, wherein the absorber is made of foam.

3. The system of claim 1, wherein the absorber is made of rubber.

4. The system of claim 1, wherein the absorber is positioned in front of a diaphragm of the loudspeaker, the absorber being directly adjacent to the loudspeaker.

5. The system of claim 1, wherein the absorber is positioned behind the loudspeaker opposite to a diaphragm of the loudspeaker.

6. The system of claim 1, wherein the absorber is positioned between a diaphragm and a magnet of the loudspeaker.

7. A system comprising:

a loudspeaker;

an absorber operatively positioned relative to the loudspeaker, the absorber being configured to absorb sound waves, the absorber including a first absorber and a second absorber, and the first absorber and the second absorber being positioned on opposite lateral sides of the loudspeaker, and the first absorber and the second absorber extend beyond a back end of the loudspeaker; and a control circuit operatively connected to the loudspeaker, the control circuit being configured to tune a resonance of the loudspeaker, thereby causing an acoustic impedance of the loudspeaker to be adjusted.

8. A system comprising:

a loudspeaker;

an absorber operatively positioned with respect to the loudspeaker;

a microphone, the microphone being operatively positioned proximate the loudspeaker, the microphone being configured to acquire sound data of an incoming sound wave; and a control circuit operatively connected to the microphone and to the loudspeaker, the control circuit operatively connected to receive the sound data from the microphone, the control circuit being configured to filter the sound data acquired by the microphone, the control circuit being configured to analyze the sound data to detect one or more frequencies of the filtered sound data, the control circuit being configured to cause an acoustic impedance of the loudspeaker to be adjusted based on the detected one or more frequencies.

9. The system of claim 8, wherein the absorber is made of foam or rubber.

10. The system of claim 8, wherein the absorber is positioned in front of a diaphragm of the loudspeaker.

11. The system of claim 8, wherein the absorber is positioned behind the loudspeaker opposite to a diaphragm of the loudspeaker.

12. The system of claim 8, wherein the absorber includes a first absorber and a second absorber, and wherein the first absorber and the second absorber are positioned on opposite lateral sides of the loudspeaker.

13. The system of claim 8, wherein the absorber is positioned between a diaphragm and a magnet of the loudspeaker.

14. The system of claim 8, further including a space defined at least partially by a first wall and a second wall, wherein the first wall and the second wall define a corner, wherein a cavity is defined in the corner, and wherein the loudspeaker is operatively positioned in the cavity facing toward the space.

15. The system of claim 8, further including a duct, and wherein the loudspeaker, the absorber, and the microphone are operatively positioned in an end region of the duct.

16. The system of claim 8, further including a duct, and wherein the loudspeaker, the absorber, and the microphone are operatively positioned in branched relation along the duct.

* * * * *